US009370692B2

(12) United States Patent
Czech

(10) Patent No.: US 9,370,692 B2
(45) Date of Patent: Jun. 21, 2016

(54) ACTIVE CAM DEVICE

(71) Applicant: Nathanial James Czech, Airway Heights, WA (US)

(72) Inventor: Nathanial James Czech, Airway Heights, WA (US)

( * ) Notice: Subject to any disclaimer, the term of this patent is extended or adjusted under 35 U.S.C. 154(b) by 305 days.

(21) Appl. No.: 13/971,690

(22) Filed: Aug. 20, 2013

(65) Prior Publication Data

US 2015/0001360 A1 Jan. 1, 2015

Related U.S. Application Data

(60) Provisional application No. 61/841,425, filed on Jul. 1, 2013.

(51) Int. Cl.
*A47F 5/08* (2006.01)
*A63B 29/02* (2006.01)

(52) U.S. Cl.
CPC ..... *A63B 29/024* (2013.01)

(58) Field of Classification Search
CPC combination set(s) only.
See application file for complete search history.

(56) References Cited

U.S. PATENT DOCUMENTS 4,184,657 A 1/1980 Jardine
4,565,342 A * 1/1986 Grow ..... A63B 29/024 248/231.9
4,572,464 A * 2/1986 Phillips ..... A63B 29/024 248/231.9
4,575,032 A * 3/1986 Taylor ..... A63B 29/024 248/231.21
4,643,377 A * 2/1987 Christianson ..... A63B 29/024 248/231.9
4,645,149 A * 2/1987 Lowe ..... A63B 29/024 248/231.9
4,712,754 A * 12/1987 Brodie ..... A63B 29/024 248/200
4,781,346 A * 11/1988 Banner ..... A63B 29/024 248/231.9
4,832,289 A * 5/1989 Waggoner ..... A63B 29/024 248/231.9
4,923,160 A * 5/1990 Waggoner ..... A63B 29/024 248/200
5,617,767 A * 4/1997 Nikoden ..... A63B 29/024 29/259
5,860,629 A * 1/1999 Reed ..... A63B 29/024 248/231.9
6,042,069 A * 3/2000 Christianson ..... A63B 29/024 248/231.9
6,375,139 B1 * 4/2002 Murray ..... A63B 29/024 248/231.9
6,736,359 B2 * 5/2004 Murray ..... A63B 29/024 248/231.9
7,014,156 B2 * 3/2006 Apezetxea ..... A63B 29/024 248/231.9
7,040,588 B2 5/2006 Lowe
7,258,316 B2 * 8/2007 Reeves ..... E04G 21/3261 248/231.91
7,278,618 B2 * 10/2007 Tusting ..... A63B 29/024 182/3
9,079,065 B2 * 7/2015 Perkins ..... A63B 29/024
2002/0162927 A1 * 11/2002 Brown ..... A63B 29/024 248/231.9
2004/0035992 A1 * 2/2004 Watts ..... A63B 29/024 248/231.9
2005/0037023 A1 * 2/2005 Field ..... A63B 29/024 424/195.15
2005/0098696 A1 * 5/2005 Lowe ..... A63B 29/024 248/231.9
2005/0161565 A1 * 7/2005 Tusting ..... A63B 29/024 248/231.9
2006/0231708 A1 * 10/2006 Robertson ..... A63B 29/024 248/231.9
2010/0263478 A1 * 10/2010 Reed ..... A63B 29/024 74/567

* cited by examiner

*Primary Examiner* — Monica Millner
(74) *Attorney, Agent, or Firm* — Lee & Hayes, PLLC

(57) ABSTRACT

An anchor assembly is described and which includes two bodies with a common axle between them and with a shaft mounted to each body distal to the axle, there being a plurality of lobes, each having a first end, a distal tip, and a raised portion, mounted on the shafts and axle, the shaft receiving lobes rotating in the opposite direction to the axle receiving lobes and with the lobes caused to rotate by a slideably moveable trigger from a first position with the tips below a horizontal plane defined by the shaft and axle centerline to a second position with the tips on the opposite side of the horizontal plane causing the anchor assembly to have a first dimension, and a second position where the rotation of the lobes causes the anchor assembly to have a second dimension which is lesser than the first dimension.

15 Claims, 16 Drawing Sheets

ACTIVE CAM DEVICE

This application claims the benefit of U.S. Provisional Application No. 61/841,425 filed on Jul. 1, 2013, which is incorporated by reference herein in its entirety.

BACKGROUND

Spring loaded camming devices are used by rock climbers to help safely climb the steep walls of a natural rock surface by presenting a fall protection point which does not damage the existing rock surface.

While climbing a rock surface, a climber typically wears a safety harness which has a rope attached to it. This rope has to be connected to the rock surface at intervals as the climber progresses up the rock face such that if a fall occurs, the distance of the fall is limited due to the last connection point being fairly close by.

Historically these fall protection points were provided by devices such as bolts or pitons, which are attached to the rock either by drilling a hole and inserting a threaded fastener or by pounding a metal loop with a spike into the rock face. Either of these options permanently damages the rock face and is time consuming and requires dedicated tools.

In the 1970's another option was invented—that of the spring loaded camming device (U.S. Pat. No. 4,184,657). Spring loaded camming devices work on the principle of the logarithmic spiral—essentially a triangle wrapped around an axle providing a constantly enlarging outside diameter as the camming device is actuated allowing them to be placed into existing cracks in the rock surface. These types of devices have been in common use ever since as they require no tools to use, do not damage the existing rock face, and can easily be recovered. The devices function with opposing lobes with an outer periphery defined by a logarithmic profile which make contact with opposing rock faces and because of the geometry the contact point with the rock surface lies below the pivot point of the lobes, any applied force is translated between the rock face and the pivot point and from there to the stem of the camming device and to the rope connected to the rock climber.

For many years there were only two basic variations of the camming device—those that operated on a single axis and those that operated on two axes. The two axis models had an advantage in that they were able to encompass a wider range of openings in a single device. This was due to the pivot points being offset from each other and a larger initial radius being able to be used which allowed for a larger difference in width between 'open' and 'closed' positions, this is important because having a device with a large range of position allows for a more versatile device which means that the climber does not have to carry as many devices on their climb.

However there is a deficiency in the prior art in that the lobe axle shaft of the second axis is required to go through apertures in the lobes mounted on the first axis. Therefore, the overall lobe rotation in these devices is only approximately ninety degrees. This amount of rotation limits working distance.

In the mid 2000's, improved spring loaded camming devices were introduced which had much greater working ranges. One of these (U.S. Pat. No. 7,040,588) called the 'link cam' uses lobes which hinge together and unfold as the camming device is actuated. This results in a much improved range over previous devices but includes a complicated hinge mechanism which also adds significant weight.

Another device (U.S. Pat. No.: 20050037023) called the 'super cam' introduced at about the same time uses lobes of different sizes rotating about a common axis, the smaller of which is allowed to rotate through some 200° degrees of motion. This device also has improved range over previously existing devices, and is simpler to produce, but still does not have the range afforded by the 'link cam'. All of the devices which have improved range also have an added weight penalty; therefore, a device with an increased range without added weight is desirable.

BRIEF SUMMARY OF THE INVENTION

This invention relates generally to the field of climbing tools and more specifically to a spring loaded camming devices.

The primary object of the invention is to provide an improved climbing cam device that allows the cam lobes to pivot around their axis from a point where the tips lay below a horizontal axis to the point that they lay well above, each lobe having rotated approximately three quarters of the way around in a circle, giving a wide gripping range.

Another object of the invention is to provide an improved climbing cam device that is light weight.

While the camming devices are described in various embodiments herein in the context of camming devices for rock climbing, the camming devices may also be used and adapted for other purposes. For example, the camming devices may be used and adapted for use in other anchoring and/or attachment operations.

In an embodiment of the invention, there is disclosed a climbing cam device having two rotateable lobes. In another embodiment of the invention, there is disclosed a climbing cam device having four rotateable lobes. While climbing cam devices are described having two or four lobes, any number of rotateable lobes may be used.

In another embodiment of the invention, there is disclosed a climbing cam device comprising: an end sleeve, a thumb rest, a pair of upper sleeves, a pair of lower sleeves, a spring mount, a wire rope, four extension springs, a retraction cable guide, four retraction cables, four retraction wires, eight swages, a left and a right body, an axle, two half shafts, four lobes with outer surfaces substantially defined by a logarithmic spiral, four lobe washers, eight pins, a finger operated trigger, the wire rope being flexible and extending through the end sleeves and the upper and the lower sleeves, the wire rope ends terminating in apertures located at the bottom of each of the bodies, the finger operated trigger and the spring mounting bar horizontally disposed between the upper sleeves and the lower sleeves, the thumb rest attached in a horizontal orientation between the end sleeve, the extension springs vertically mounted between the spring mount and the retraction cables, the retraction cables wrapping around a raised portion on each lobe and being fixed at the cross pin in each cam lobe and having one end terminate at a spring via a swage and the opposite end terminating via a swage at a retraction wire which extends to the trigger, each body having a shaft retaining aperture near each end of the horizontal portion of the body, a first lobe rotatably attached to the outer surface of said horizontal portion of the left body, a second said lobe rotatably attached to the inner surface of said horizontal portion of the left body, a third said lobe rotatably attached to the inner surface of said right horizontal portion of the right body, a fourth said lobe rotatably attached to the outer surface of said right body and so that when a user presses up with his thumb on said thumb rest and presses down said finger operated trigger with the forefinger and middle finger said cam lobes are caused to rotate about said axle shaft members allowing said lobes to be retained in a rock crevice.

BRIEF DESCRIPTION OF THE DRAWINGS

The drawings constitute a part of this specification and include exemplary embodiments to the invention, which may be embodied in various forms.

It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 13:
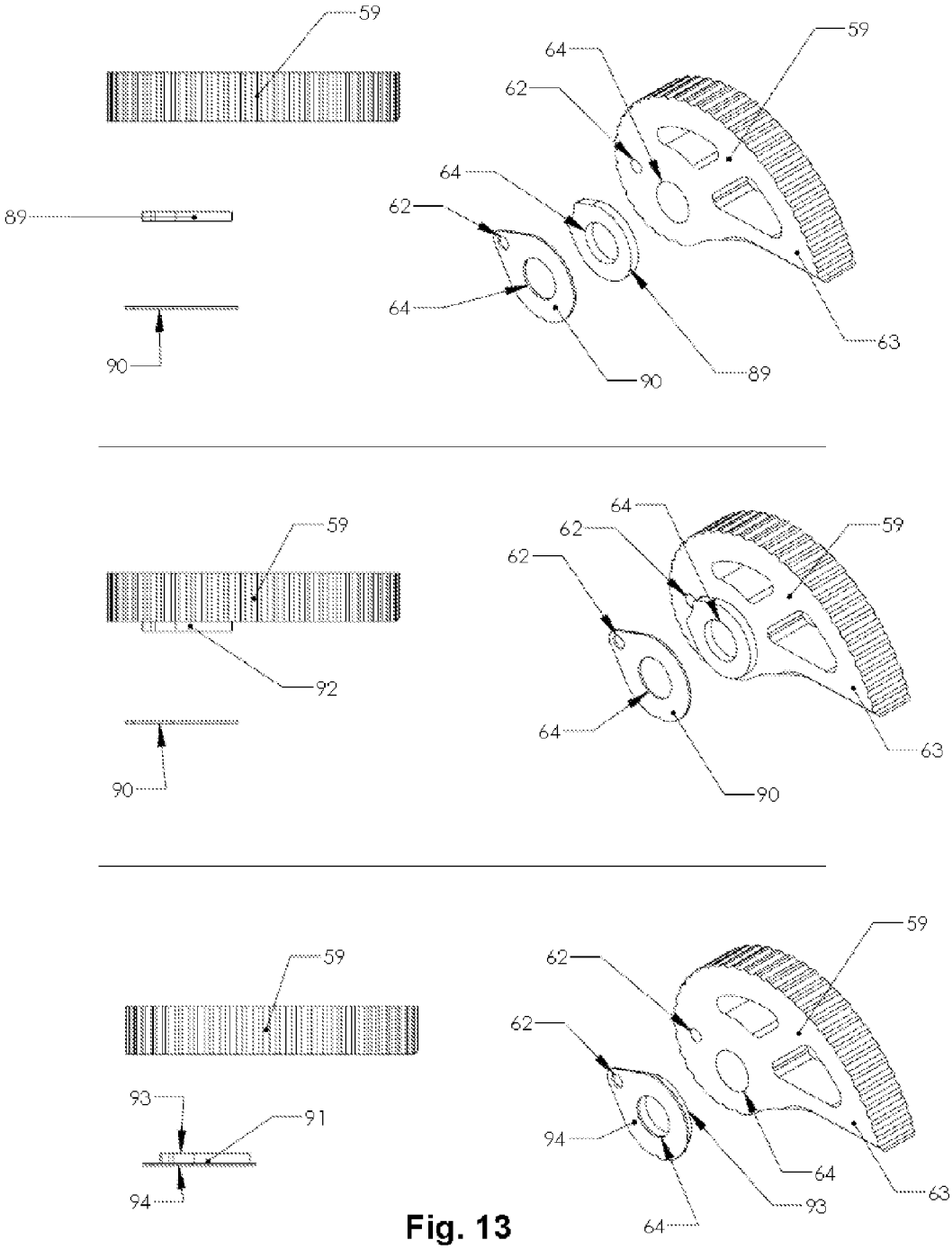
FIG. 13 is multiple views of alternative cam lobe construction.
Figure 14:
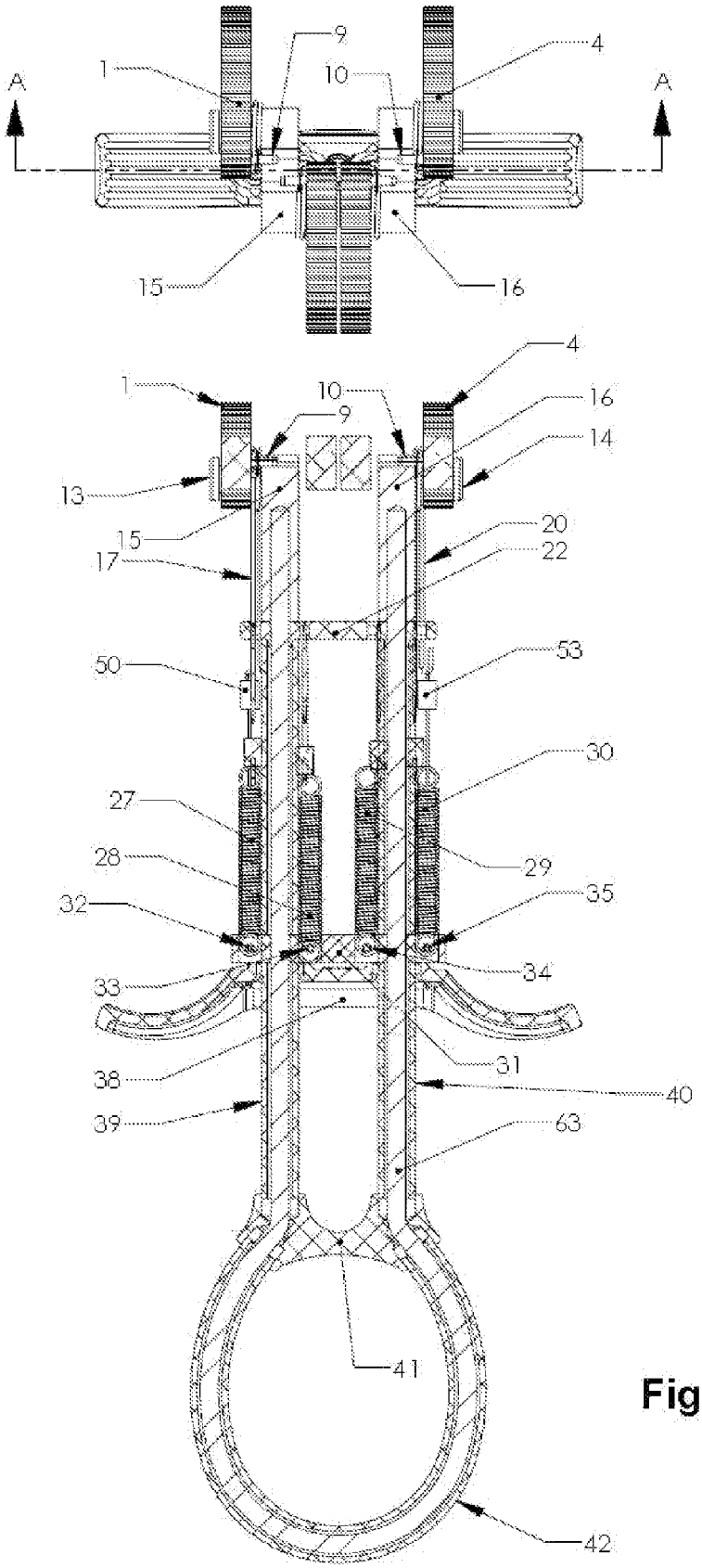
FIG. 14 is a top view and a section view of the device.

FIG. 14 illustrates the camming device having a wire rope 63 which terminates at each end in a body 15, 16, to which it is fixed. The wire rope 63 runs through a series of upper sleeves 36, 37, lower sleeves, 39, 40, and an end sleeve 42, as shown in FIGS. 1, 2, 6, and 13.

Sitting below the bodies 15, 16 is a spring guide 22, which serves to guide retraction cables 17, 18, 19, 20 and which also has the wire rope 63 passing through it. Below the spring guide 22, around the wire rope 63 are the upper sleeves 36, 37, which act to protect the wire rope 63 and correctly define the distance to the next piece which is aligned on the wire rope 63 which is the spring mount 31. The spring mount, serves as the base fixing point for springs 27, 28, 29, 30 which are coupled to the spring mount 31 by means of pins 32, 33, 34, 35, which pass horizontally through the spring mount 31.

FIG. 14 illustrates the lower sleeves 39, 40, which serve to protect the wire rope and correctly space the distance between the spring mount 31 and a thumb rest 41. These lower sleeves 39, 40, also serve as travel guides for a trigger 38. Passing through either side of the thumb rest 41 is both the wire rope 63 and the end sleeve 42 which forms a loop to serve the purpose of connection via a sling (not shown) or carabineer (not shown) ultimately to the rock climber.

Figure 12:
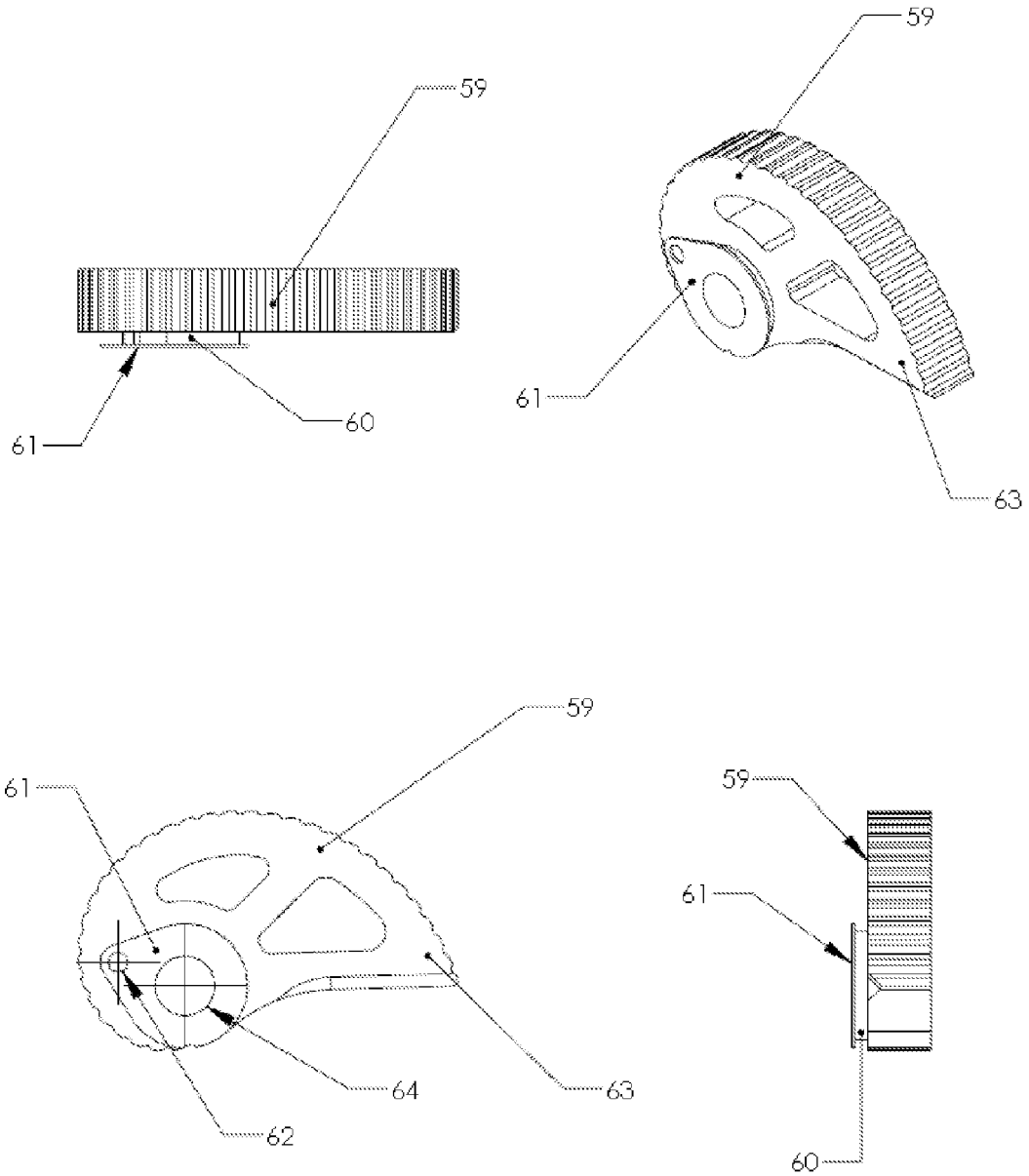
FIG. 12 is multiple views of a cam lobe.

A lobe 59 in FIG. 12 has a rotational hole 64 and a hole for a pin 62 which serves as a retraction cable (not shown in FIG. 12) attachment point and as a travel stop. A raised portion 60 sitting between the lobe 59 and a lobe washer 61 serves as a spool about which the retraction cable can coil when the lobe is moved to different rotational positions. This raised portion 60 is shown monolithic with the lobe 59. For example, the raised portion 60 and the lobe 59 and the washer 61 may be formed of a single unit of steel, stainless steel, aluminum, titanium, composite (e.g., carbon fiber), or a polymeric material.

Further, as shown in FIG. 13, there may be alternative constructions of the lobe the components being composed of one or more discrete components. In the first example, the lobe 59 is a separate component from the spool 89 and washer 90. These may each be made of differing materials to accomplish lightweight or strength as desired.

The lobe 59 might be of a high strength material such as steel, stainless steel, aluminum, titanium, or a strong polymeric material while the spool might be a lightweight plastic and the washer a stainless steel. Another construction shown might have the lobe 59 with an integrated raised portion 92 and the washer 90 of a separate piece. This also allows for efficient manufacturing methods to be used.

Another method of manufacture has the washer 94 combined with the spool 93 to form a single unit 91 which is then used together with the lobe 59. In each of these constructions, there is an aperture 64 for receiving a shaft or axle.

Figure 7:
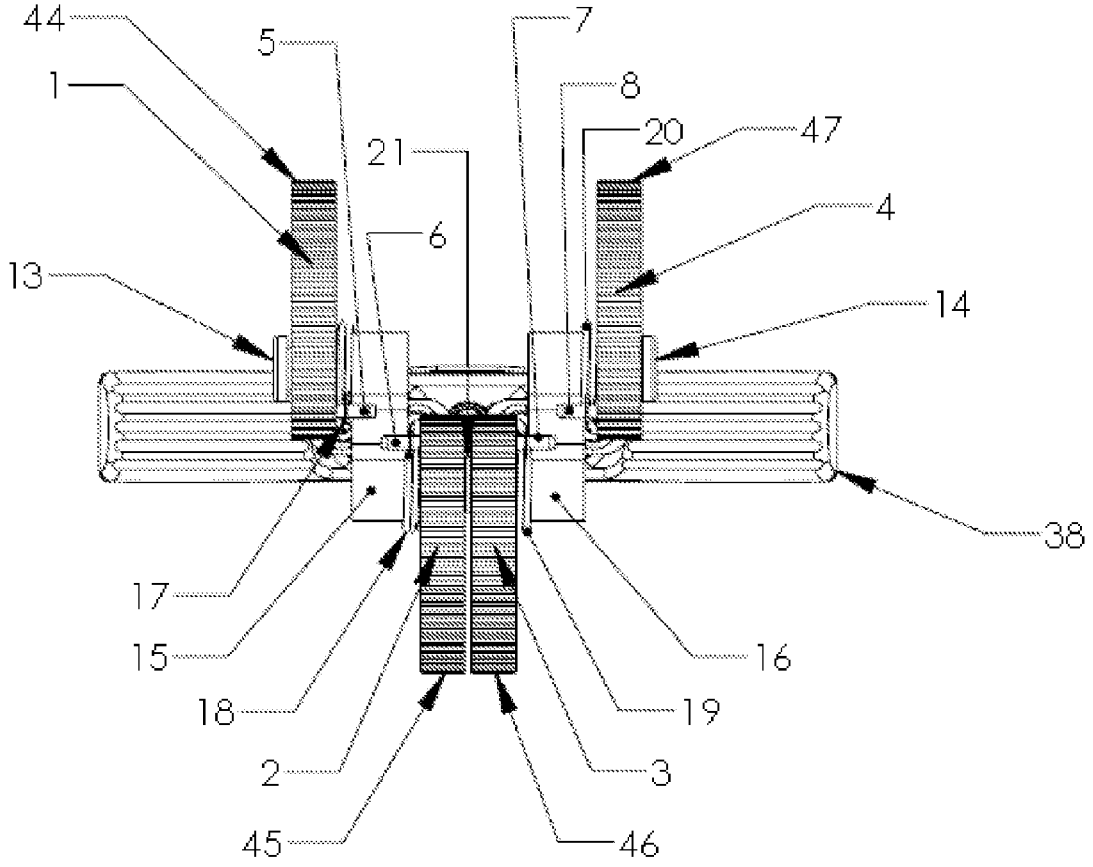
FIG. 7 is a top view of the camming device in its extended condition.
Figure 8:
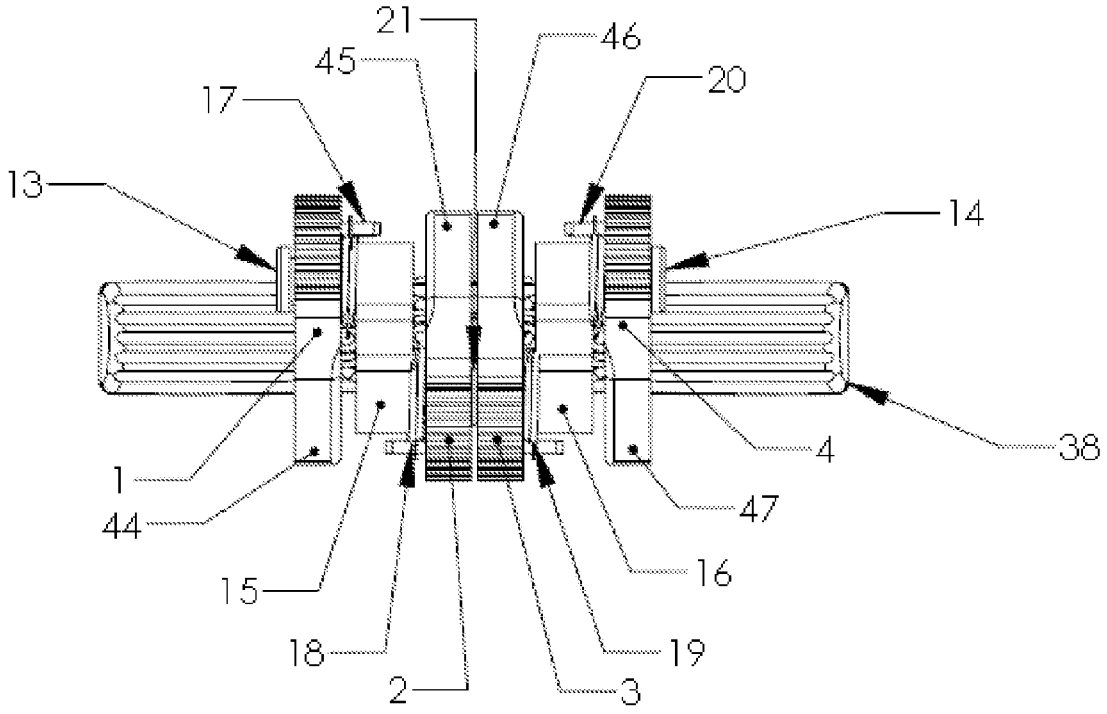
FIG. 8 is a top view of the camming device in its collapsed condition.

Each lobe is it appears in FIG. 12 also has a mirror image of such. In FIG. 7, lobes 1 and 2 are mirrored components of 3 and 4. This is also true for the alternative constructions shown in FIG. 13.

An anchoring device as claimed in claim 16 wherein the independent lobe comprises a first unit, and the raised portion comprise a second unit. The head of the camming device is constructed as shown especially in FIGS. 1, 2, 5, 6, 7, and 8. Onto the body 15 is fixed the half shaft 13 which has the lobe 1 rotationally mounted about it. Onto the body 16, there is the half shaft 14 fixed to it with the lobe 4 rotationally mounted.

Between lobes 15 and 16 there is the axle 43 which is fixed to both bodies and which has the lobes 2 and 3 rotationally mounted about it which has the spacer 21 between them. Each of the lobes 1, 2, 3, 4, are approximately the same size differing only in being a left or right hand version. As described in the paragraph above, each lobe also has a raised portion and a washer with a hole for a pin.

The pin for lobe 1 is numbered as 5, the pin for lobe 2 numbered as 6, the pin for lobe 3 is numbered as 7, and the pin for lobe 4 is numbered as 8. The bodies have shaft fixing points such that half shaft 13 is substantially concentric with half shaft 14. The bodies 15, 16 allow for the rotational axis of the axle 43 to be parallel but separate from the rotational axis of the half shafts 13, 14.

The rotation of the lobes is controlled thus: Each of the lobes 1, 2, 3, 4, have their own biasing springs 27, 28, 29, 30 which act through retraction cables 17, 18, 19, 20 (connected via the spring swages 50, 51, 52, 53) passing through a spring guide 22 to the connection pins 7, 8, 9, 10 on lobes 1, 2, 3, 4, and round the raised portions on the lobes and back through a spring guide 22 to the retraction wires 23, 24, 25, 26 (connected via wire swages 54, 55, 56, 57) which connect to the trigger 38.

The trigger can then be acted on, typically with the forefinger and middle finger on each of the outlaying surfaces and the thumb on the thumb rest 41, to rotate the cam lobes 1, 2, 3, 4, which in turn extends springs 27, 28, 29, 30.

Figure 9:
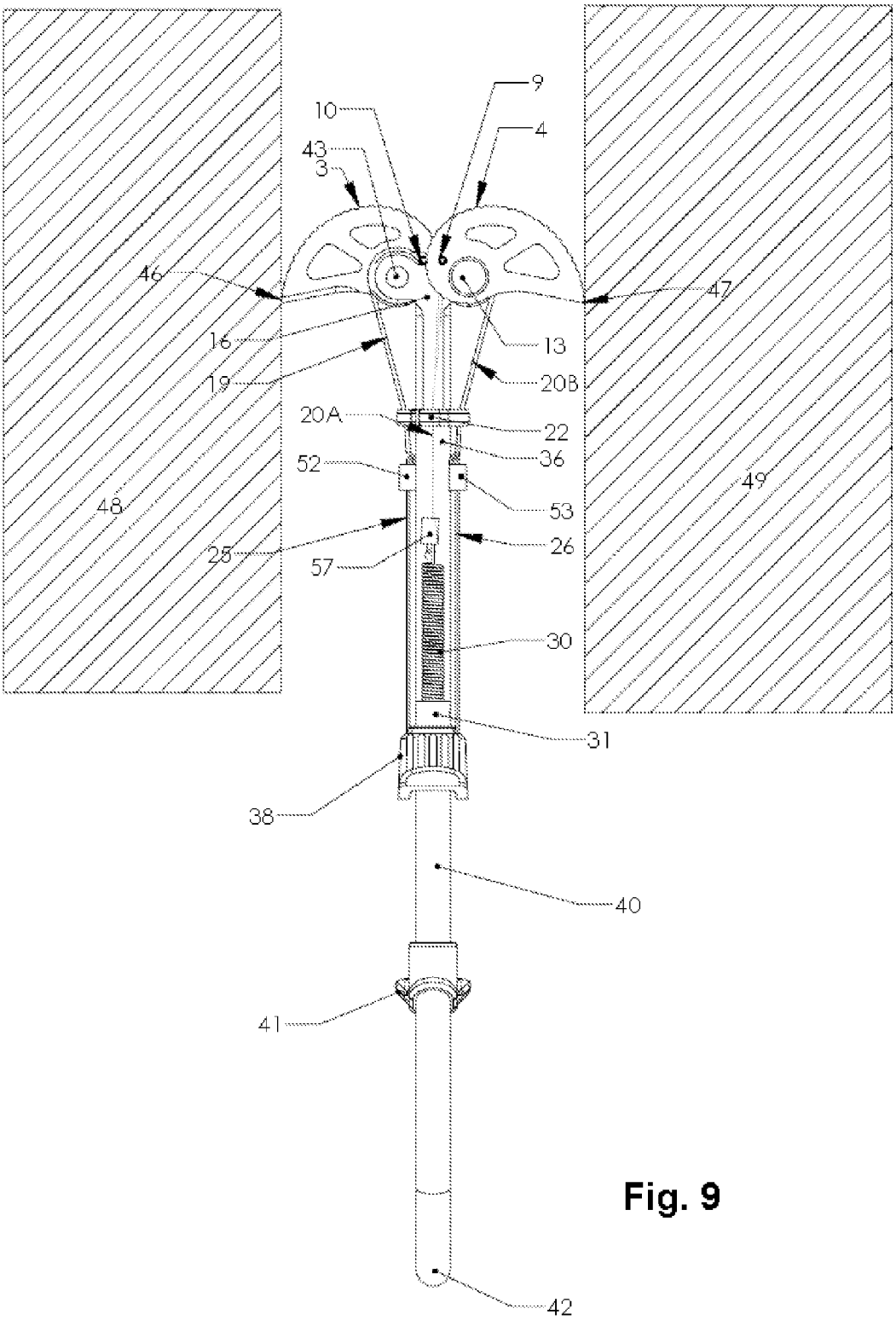
FIG. 9 is right side view of the camming device in its extended condition as placed in a parallel rock crack.
Figure 10:
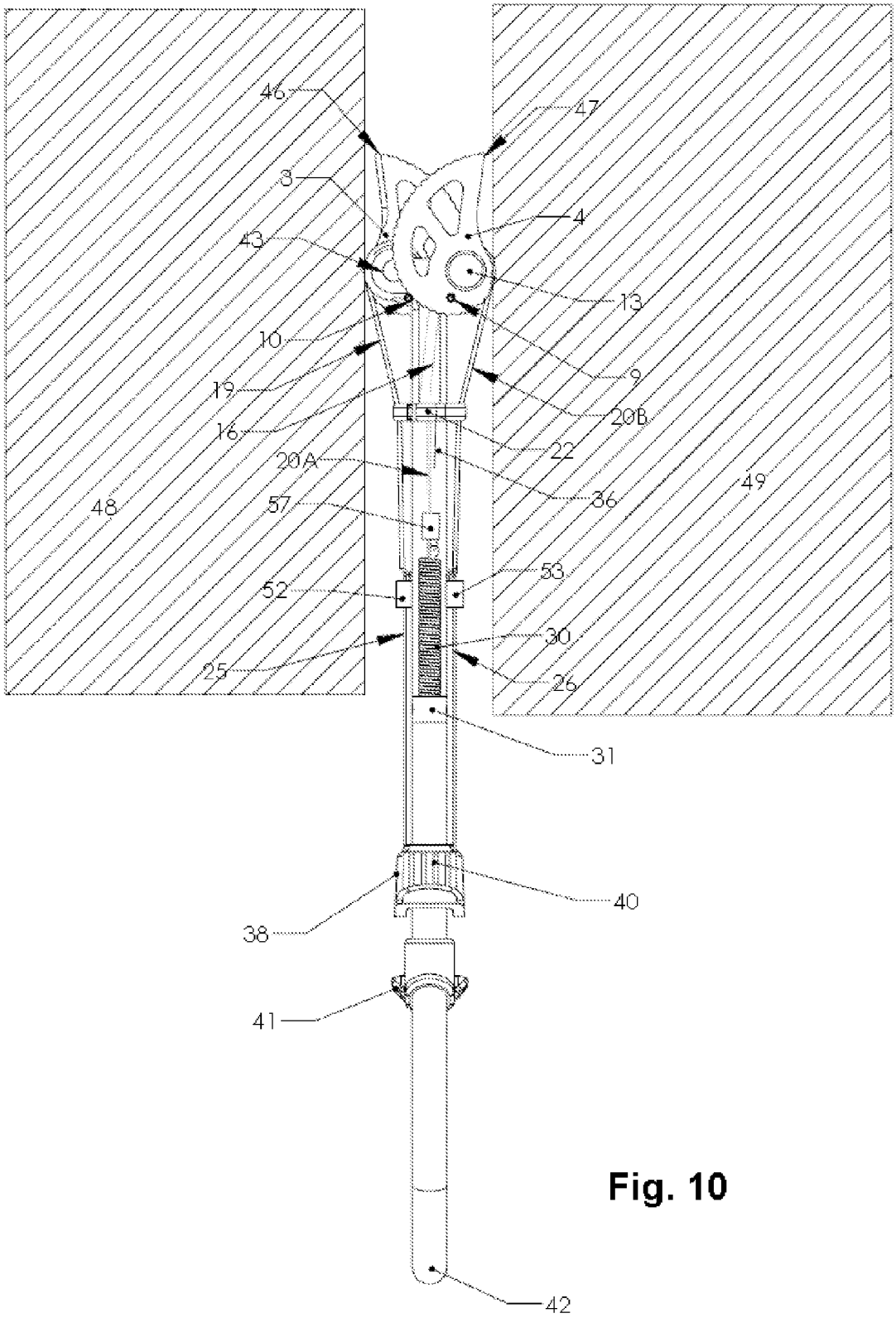
FIG. 10 is a right side view of the camming device in its collapsed condition as placed in a parallel rock crack.
Figure 11:
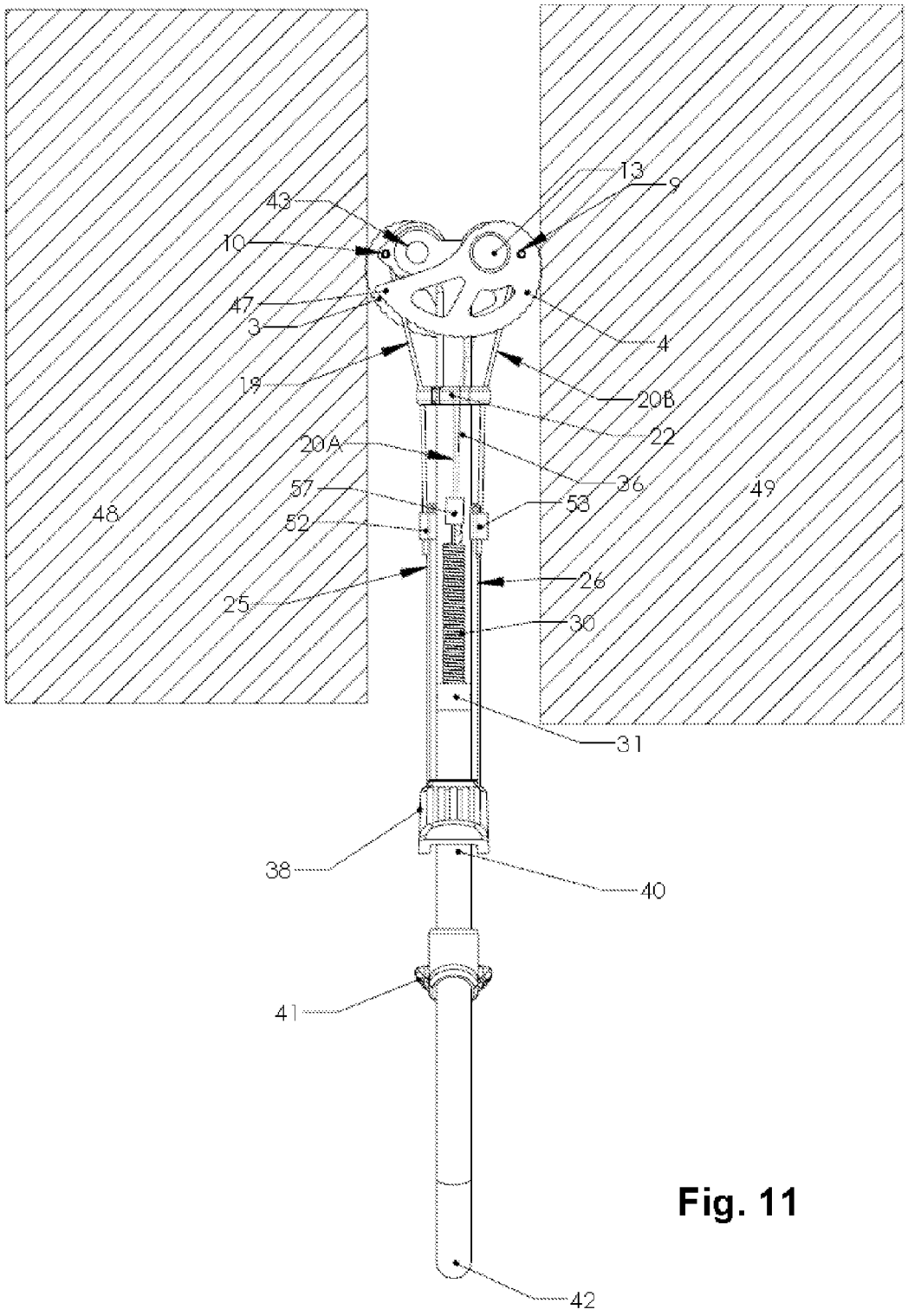
FIG. 11 is a right side view of the camming device in its mid-range condition as placed in a parallel rock crack.

The range of rotation of the lobes can be seen in the FIGS. 9, 10, and 11 showing the camming device as placed in a parallel rock crevice.

Note that the tips 46, 47 in FIG. 9 are at their outermost extension to make contact with the rock surfaces 48, 49.

In FIG. 11 lobes 3, 4, can be seen partially rotated.

In this novel device, it is possible that the lobes are still in contact with the rock 48, 49 but the tips 47, (46 not shown) are not in contact, the rotational axis being juxtaposed from each other.

Figure 3:
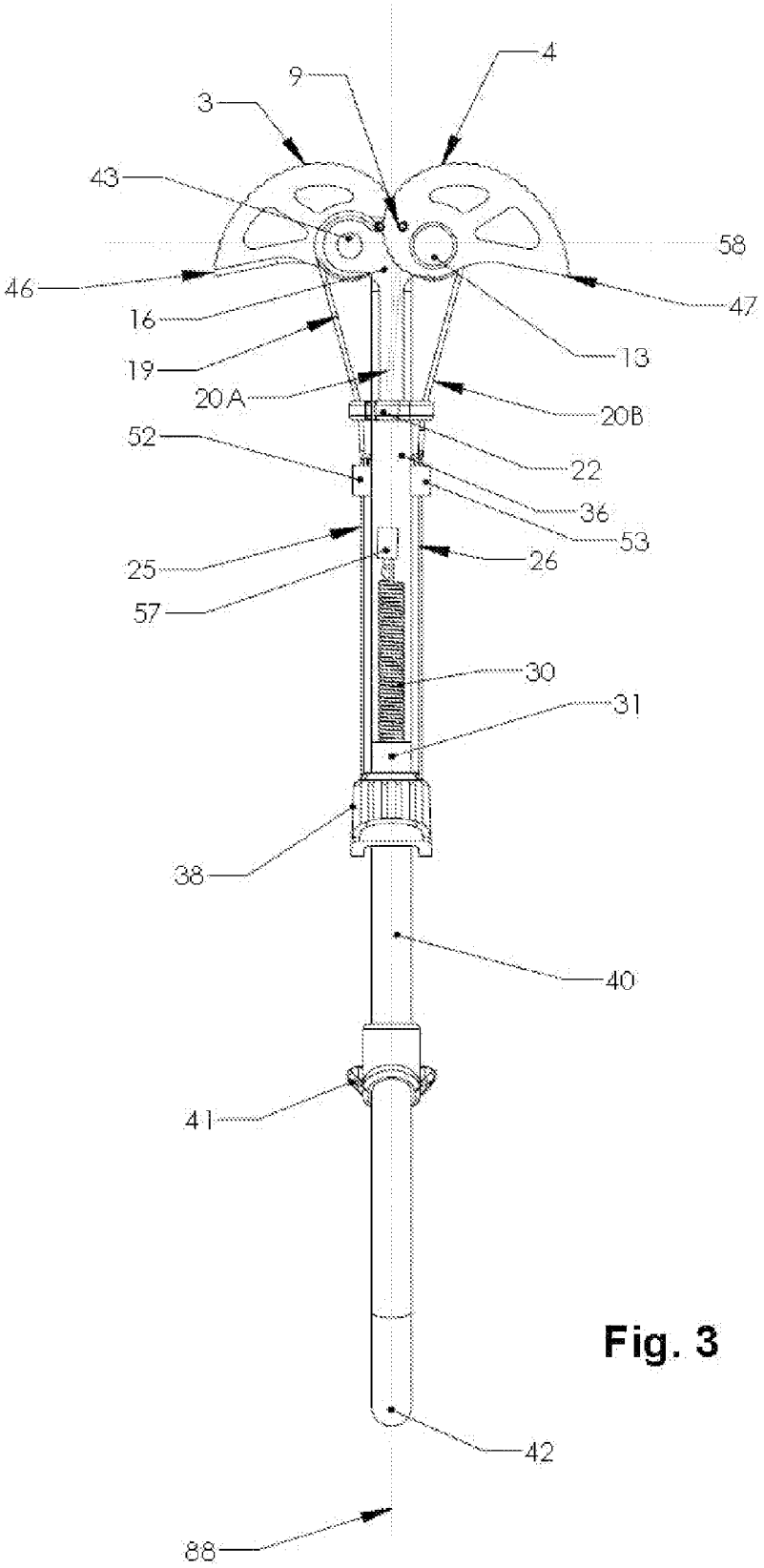
FIG. 3 is a right side view of the camming device in its extended condition.
Figure 4:
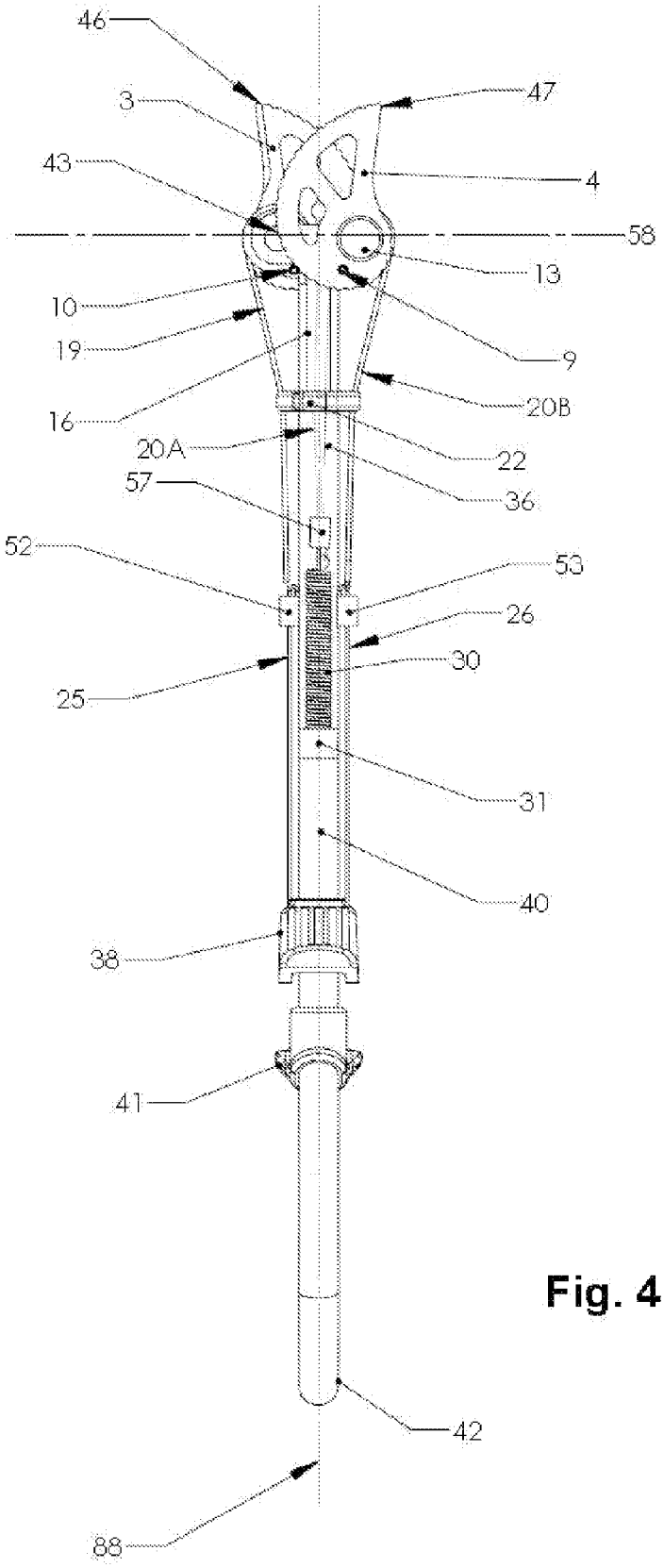
FIG. 4 is a right side view of the camming device in its collapsed condition.
Figure 5:
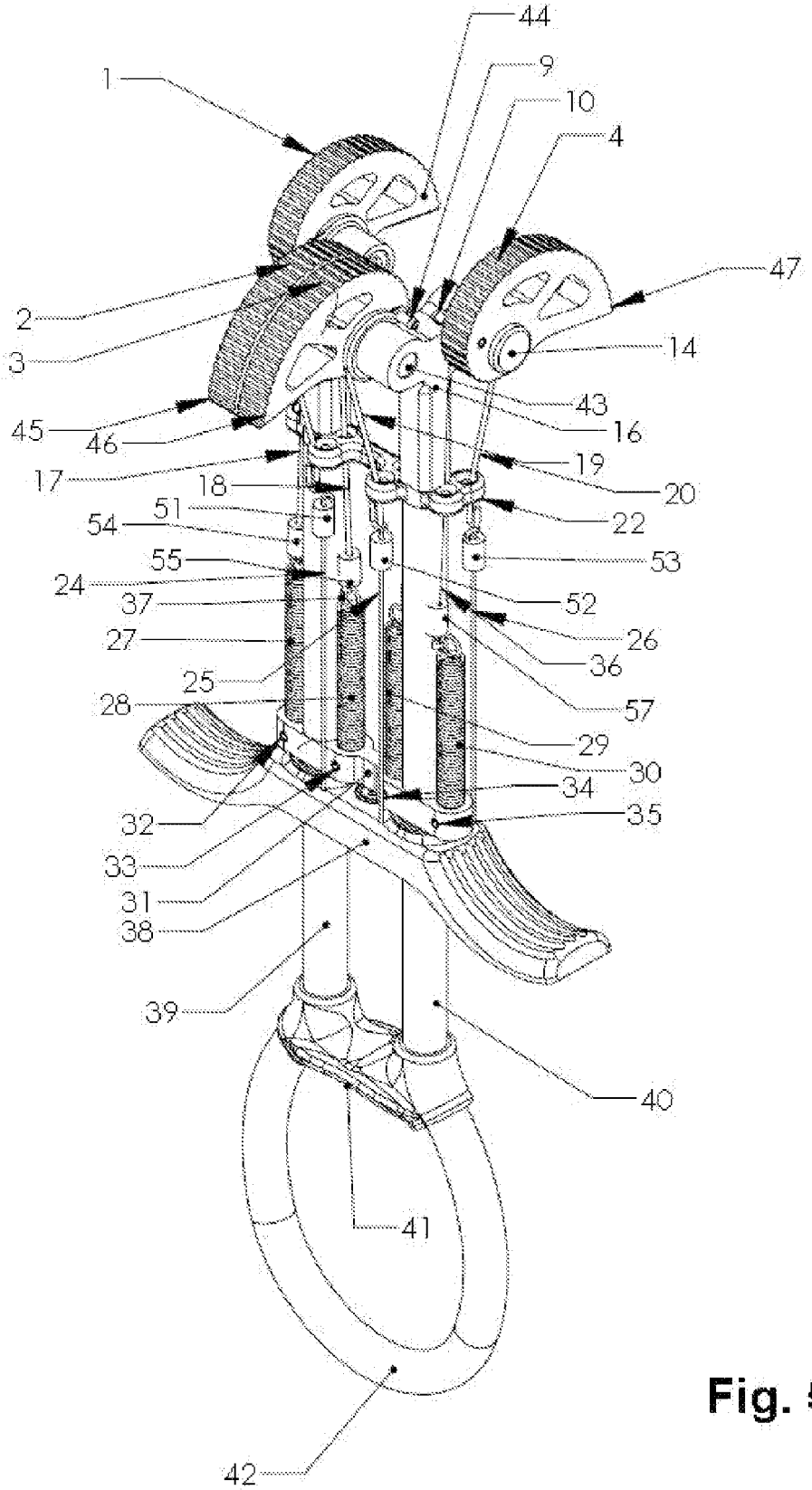
FIG. 5 is an isometric view of the camming device in its extended condition.
Figure 6:
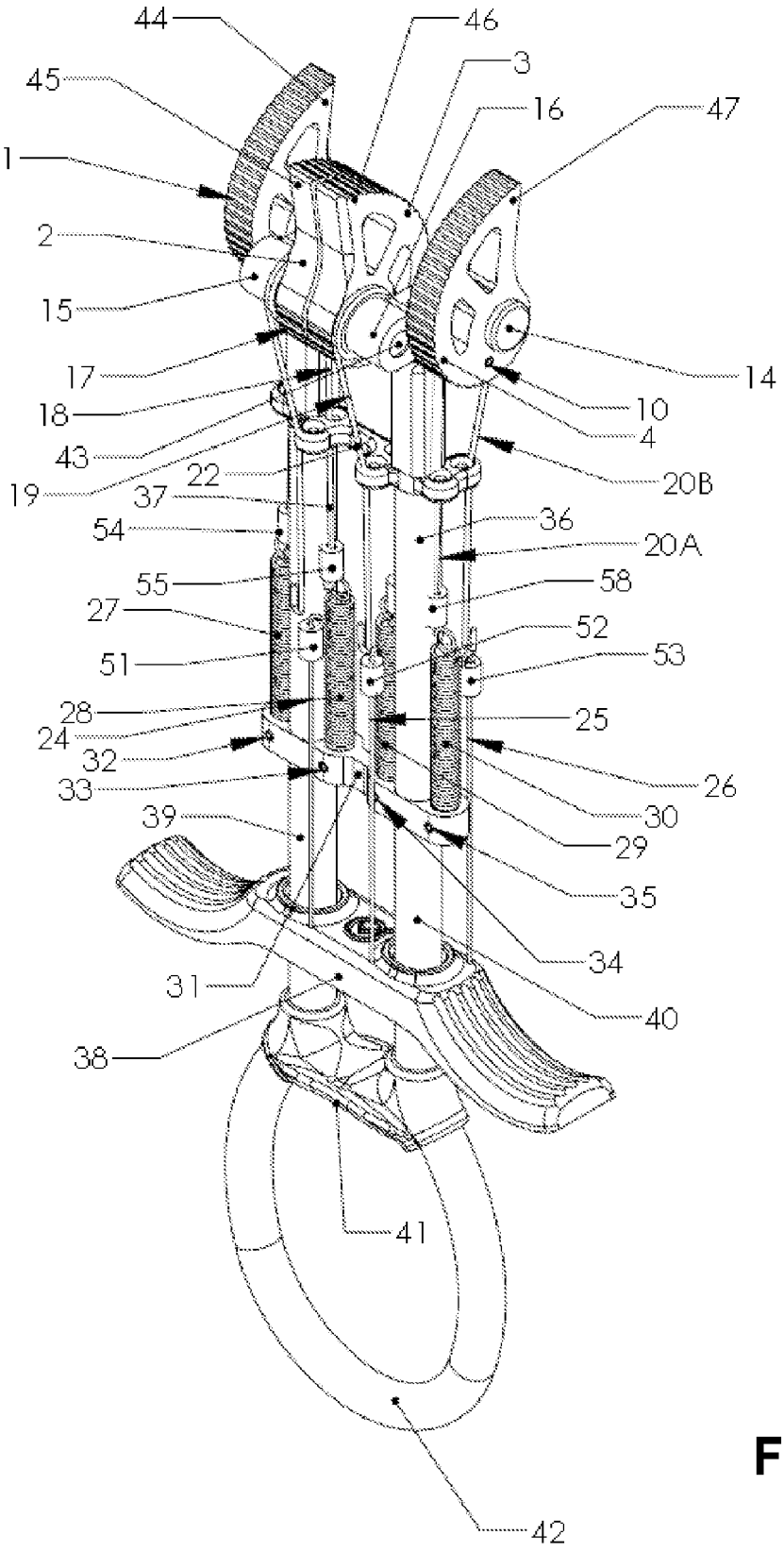
FIG. 6 is an isometric view of the camming device in its collapsed condition.

In FIG. 10 the narrowest limit of the camming device can be seen with the tips 46, 47 having been rotated completely around to points far above the horizontal plane 58, which they initially sat below in FIGS. 3 and 9.

The lobes 1, 2, 3, 4, are biased by the trigger 38 such that the first lobe 1 and the last lobe 4 are biased in one direction and the middle lobes 2, 3 are biased in a rotational direction opposite the first and last.

The springs 27, 28, 29, 30 act in a direction opposite the action of the trigger 38.

Figure 15:
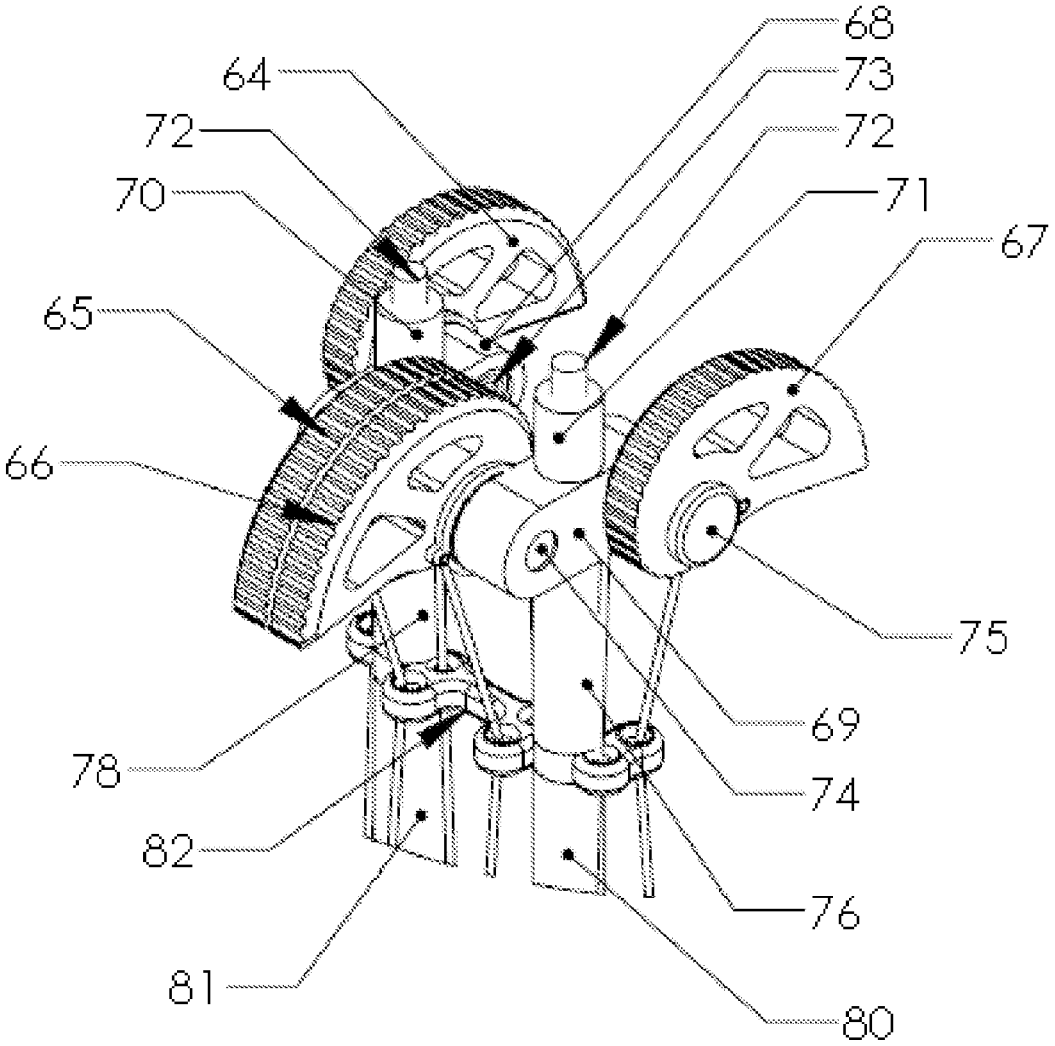
FIG. 15 is a view of an alternative embodiment specifically pertaining to the wire rope attachment to the bodies.

In FIG. 15, an alternative embodiment is shown in which the wire rope 72 passes completely through the bodies 68, 69 and terminates on the opposite side in the wire rope swages 70, 71.

The arrangement still maintains the novel aspects of this device.

Figure 1:
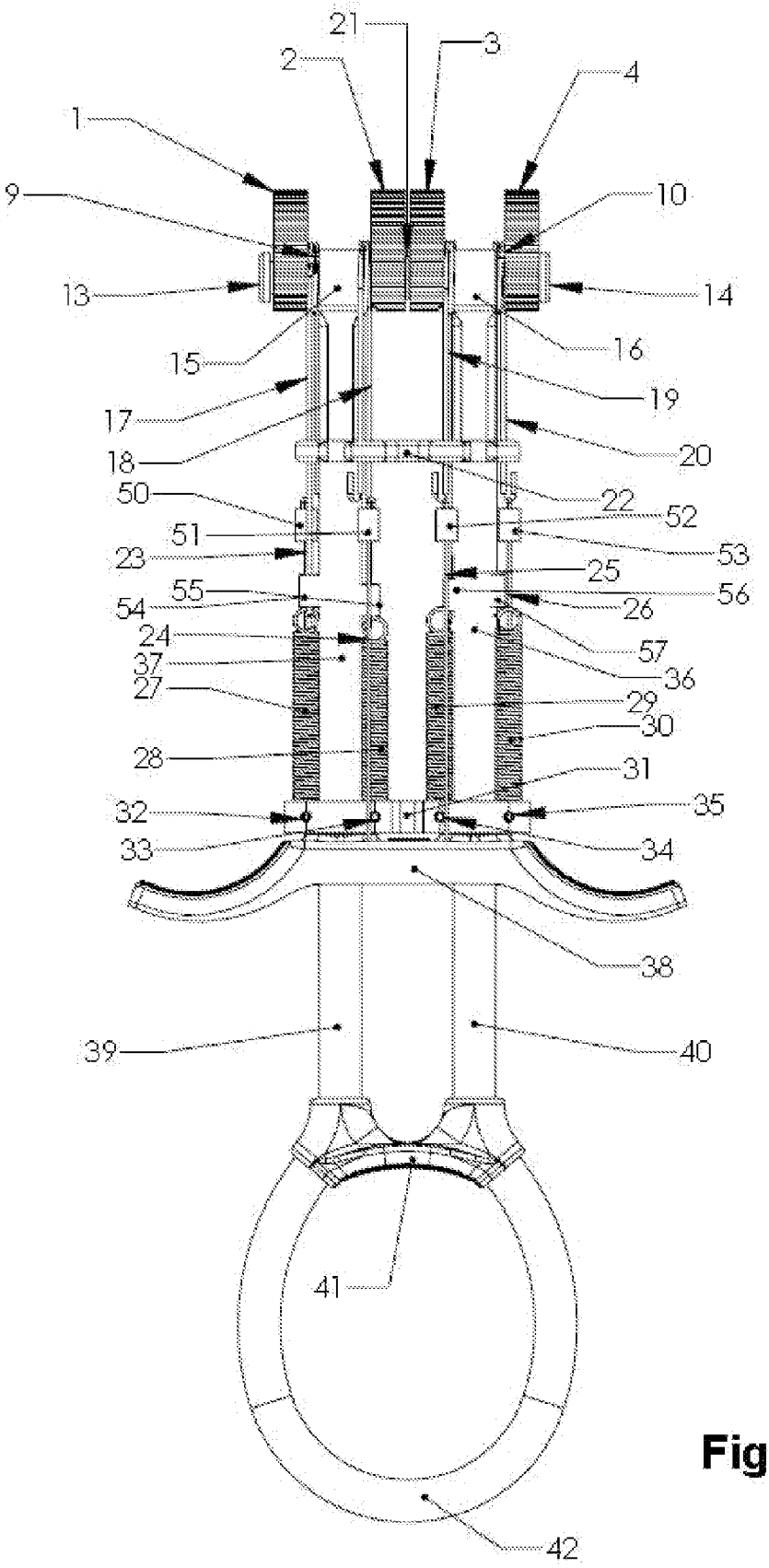
FIG. 1 is a front view of the camming device in its extended condition.
Figure 2:
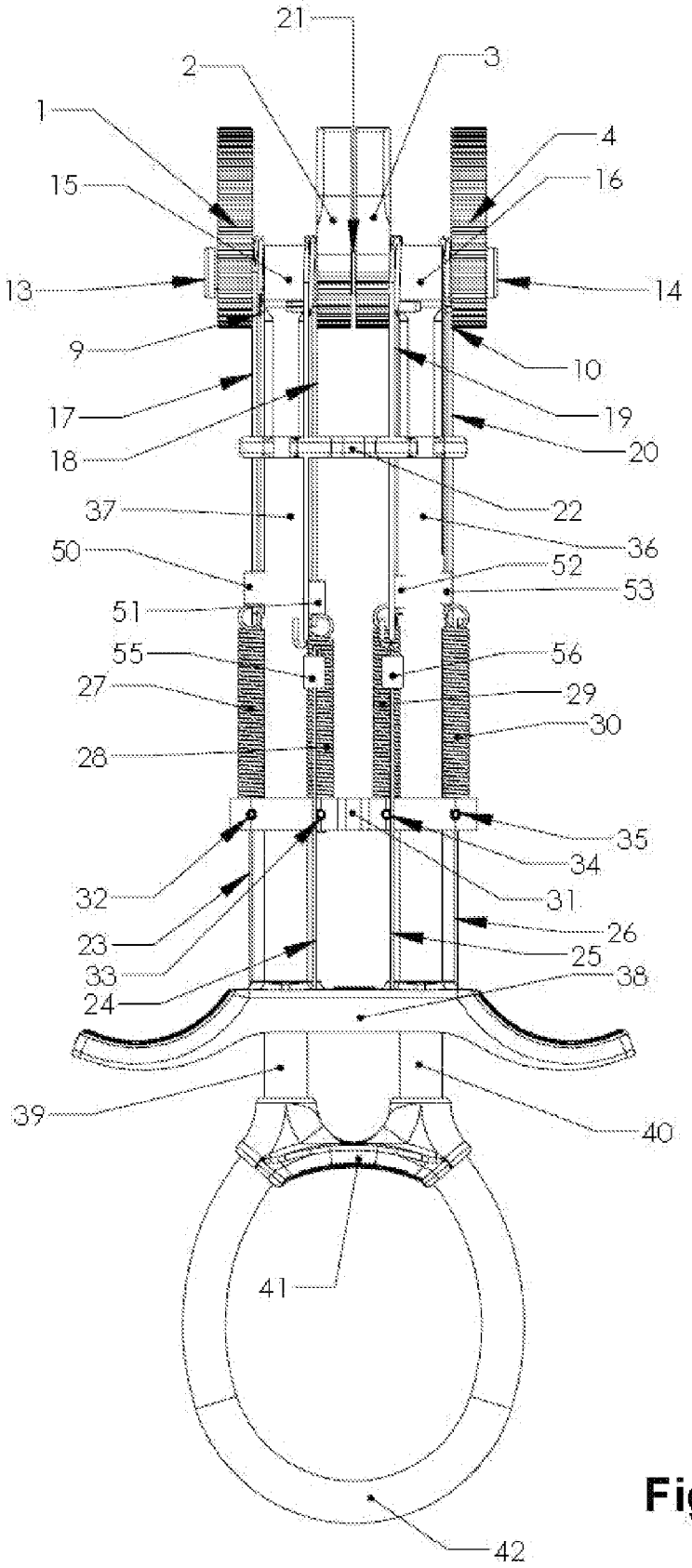
FIG. 2 is a front view of the camming device in its collapsed condition.
Figure 16:
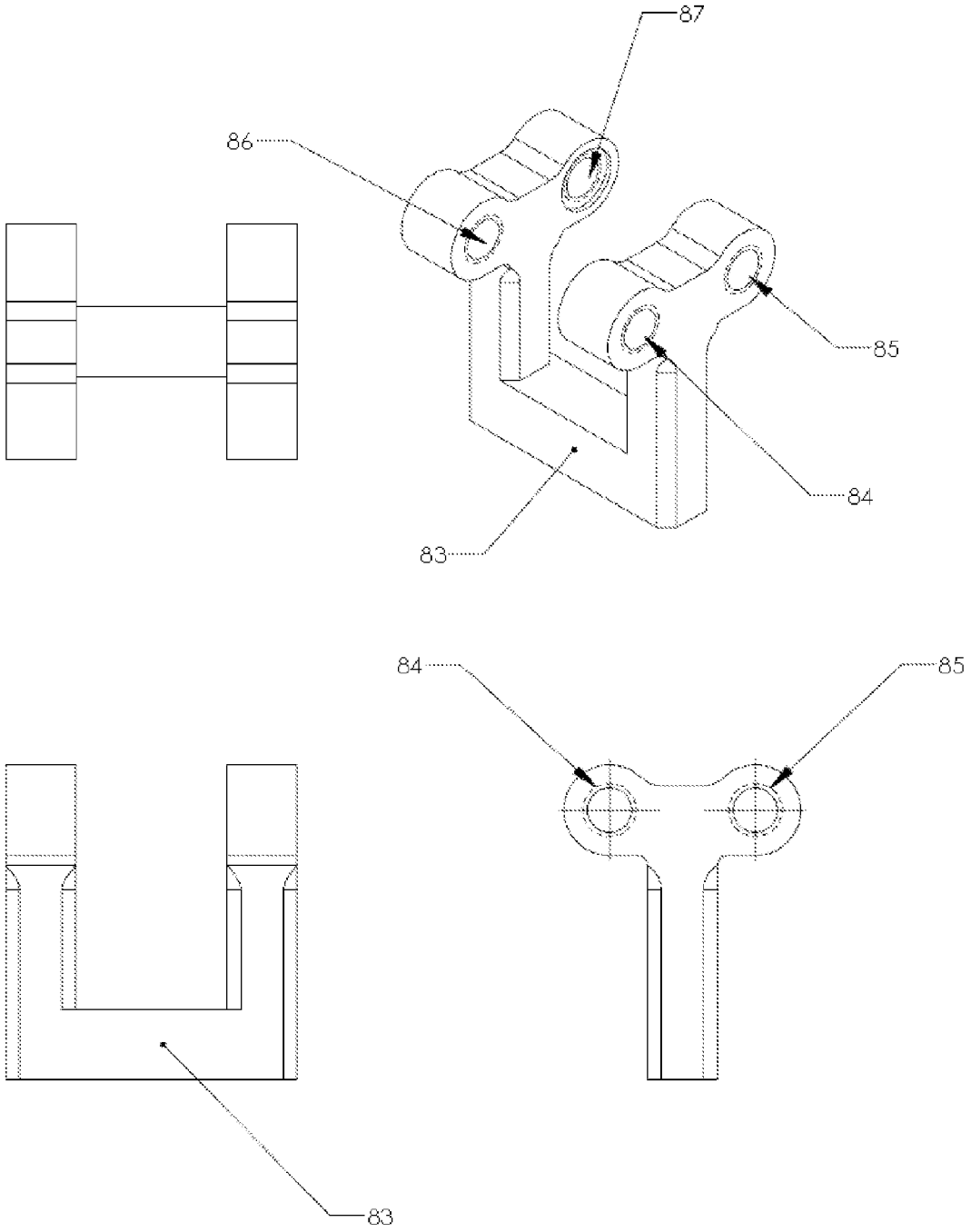
FIG. 16 shows an alternative embodiment of the bodies as monolithic.

Another alternative embodiment would be to combine the bodies 15, 16, FIG. 1 into a monolithic unit taking the form of a U as viewed from the front as shown in FIG. 16.

The axle holes 84, 86 are still present and offset from the half shaft holes 85, 87 while the body 83 forms a U shape.

The arrangement still maintains the novel aspects of this device.

The spring loaded climbing cam device of the present invention can be made out of a combination of metals and polymeric materials to reduce the weight that the climber has to carry.

CONCLUSION

Although the subject matter has been described in language specific to structural features and/or methodological acts, it is to be understood that the subject matter defined in the appended claims is not necessarily limited to the specific features or acts described.

Rather, the specific features and acts are disclosed as exemplary forms of implementing the claims.

What is claimed is:

1. An anchoring device comprising:

a head for removeably gripping with a surface, the head comprising;

a body having a shaft fixed in a first portion of the body and an axle fixed in a second portion of the body, the shaft arranged substantially parallel to the axle and defining a horizontal plane;

a first rotateable lobe pivotably coupled to the shaft fixed in the first portion of the body, the first rotateable lobe having a tip distal to an aperture receiving at least a portion of the shaft fixed in the first portion of the body, the first rotateable lobe having the ability to rotate the distal tip from a first location on one side of the horizontal plane to a second location on the other side of the horizontal plane;

a second rotateable lobe pivotably coupled to the axle fixed in the second portion of the body, the second rotateable lobe having a tip distal to an aperture receiving at least a portion of the axle fixed in the second portion of the body, the second rotateable lobe having the ability to rotate the distal tip from a first location on one side of the horizontal plane to a second location on the other side of the horizontal plane;

a tether attached to the first and second portions of the body, the tether extending away from the first and second rotateable lobes; and a trigger mechanism slideably coupled to the tether, wherein when the trigger mechanism is slideably displaced relative to the tether, the tips of the first and second rotateable lobes rotate about that shaft and the axle.

2. An anchoring device as claimed in claim 1, wherein the first and second rotateable lobes are of unequal size.

3. An anchoring device as claimed in claim 1, wherein the first rotateable lobe rotates in a first direction, and the second rotateable lobe rotates in a second direction opposite the first direction of the first rotateable lobe.

4. An anchoring device as claimed in claim 1, wherein the first rotateable lobe rotates in a first direction, and the second rotateable lobe rotates in a second direction opposite the first direction of the first rotateable lobe, further comprising a third rotateable lobe rotating in the first direction.

5. An anchoring device as claimed in claim 4, further comprising a fourth rotateable lobe rotating in the second direction.

6. An anchoring device as claimed in claim 1, wherein at least one torsion spring is used to bias the first and second rotateable lobes such that the first rotateable lobe is rotatably biased in a first direction and the second rotateable lobe biased in a second direction opposite the first direction.

7. An anchoring device as claimed in claim 1, wherein at least one biasing member acts in tension to bias the first and second rotatable lobes such that the first rotateable lobe is rotatably biased in a first direction and the second rotateable lobe is biased in a second direction opposite the first direction.

8. An anchoring device as claimed in claim 1, wherein at least one biasing member acts in compression to bias the first and second rotateable lobes such that the first rotateable lobe is rotatably biased in a first direction and the second rotateable lobe is biased in a second direction opposite the first direction.

9. An anchoring device as claimed in claim 1, wherein at least one biasing member acts in torsion to bias the first and second rotateable lobes such that the first rotateable lobe is rotatably biased in a first direction and the second rotateable lobe is biased in a second direction opposite the first direction.

10. An anchoring device comprising:

a first body and a second body;

an axle coupled to a first portion of the first body and to a first portion of the second body;

a first shaft coupled to a second portion of the first body, the first shaft substantially parallel to the axle and defining a plane, the first shaft extending from the opposite side of the first body as the axle;

a second shaft coupled to a second portion of the second body, the second shaft substantially parallel with the first shaft, the second shaft extending from the opposite side of the second body as the axle;

a first lobe rotatably mounted on the first shaft, a tip of the first lobe able to rotate to a position above the plane without intersecting the axle;

a second lobe rotatably mounted on the axle, a tip of the second lobe able to rotate to a position above the plane without intersecting the first or second shaft; and a third lobe rotatably mounted on the second shaft, a tip of the third lobe able to rotate to a position above the plane without intersecting the axle.

11. An anchoring device as claimed in claim 10, wherein the first and third lobes rotate in a first direction, and the second lobe rotates in a second direction opposite the first direction of the first and third lobes.

12. An anchoring device as claimed in claim 10, further comprising a fourth lobe rotatably mounted on the axle.

13. An anchoring device as claimed in claim 10, wherein the first and second bodies comprise a single unit having a substantially U-shape allowing the lobes to rotate without interruption.

14. An anchoring device as claimed in claim 10, further comprising a tether, wherein the tether terminates at the first and second portions of the first and second bodies.

15. An anchoring device as claimed in claim 10, wherein the tether comprises a cable.

* * * * *